United States Patent [19]

Barto, Jr. et al.

[11] 4,418,643

[45] Dec. 6, 1983

[54] FEED HOPPER ASSEMBLY FOR PARTICULATE MATERIAL AND PRINTER

[75] Inventors: Robert M. Barto, Jr., Wyckoff, N.J.; Ira Lopata, New York, N.Y.

[73] Assignee: Ragen Precision Industries, Inc., North Arlington, N.J.

[21] Appl. No.: 443,634

[22] Filed: Nov. 22, 1982

Related U.S. Application Data

[63] Continuation of Ser. No. 289,760, Aug. 3, 1981, abandoned.

[51] Int. Cl.[3] ..... G03G 15/09

[52] U.S. Cl. ..... 118/657; 118/117

[58] Field of Search ..... 118/657, 117

*Primary Examiner*—Bernard D. Pianalto

*Attorney, Agent, or Firm*—Daniel H. Bobis

[57] ABSTRACT

A feed hopper assembly particularly adapted for feeding particulate material which agglomerates has, end walls and side walls which define a storage chamber having a charging opening for the particulate material, and the side walls converge to form a discharge outlet for dispensing the particulate material. A pulsating diaphragm assembly including, an elastomeric member on the inner wall of the storage chamber, and pump means for causing the elastomeric member to expand the deflate. A transverse shelf or surface adjacent the discharge outlet can be provided for delivering the particulate material to a point of use. Bleed means can also be provided to bleed air from the pulsating diaphragm assembly in the event that pulsations terminate when the diaphragm assembly is in the expanded condition.

Also, the combination of the above described feed hopper assembly with an electrostatic printer having a magnetic toning roller, pressure fusing rollers, and means for driving the pressure fusing rollers wherein the transverse shelf acts as a doctor blade for the magnetic toning rollers, and the means for driving the pressure fusing rollers also actuates the pump for pulsing the elastomeric member of the diaphragm assembly to prepare the magnetic toning rollers for the next electrostatic image to be printed.

4 Claims, 5 Drawing Figures

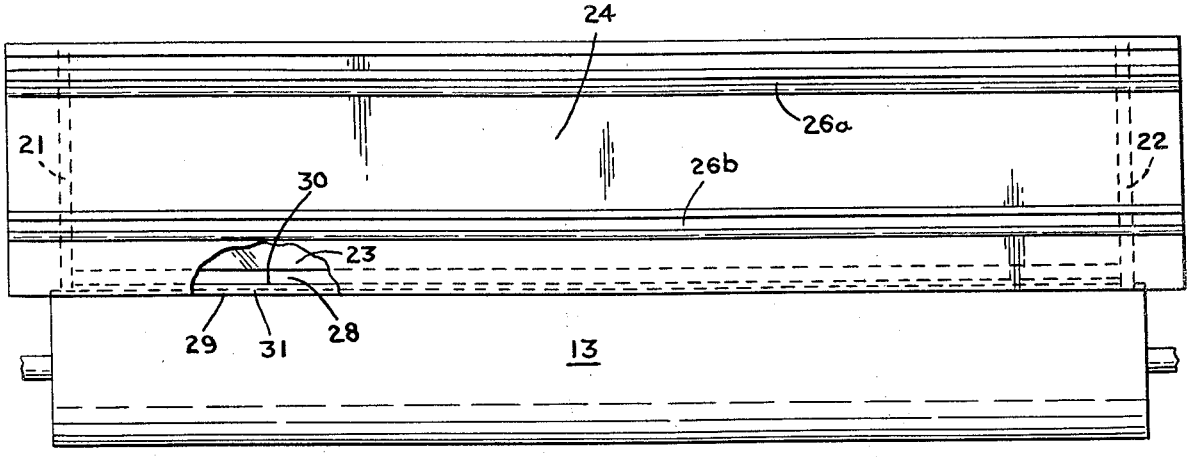
FIG. 3
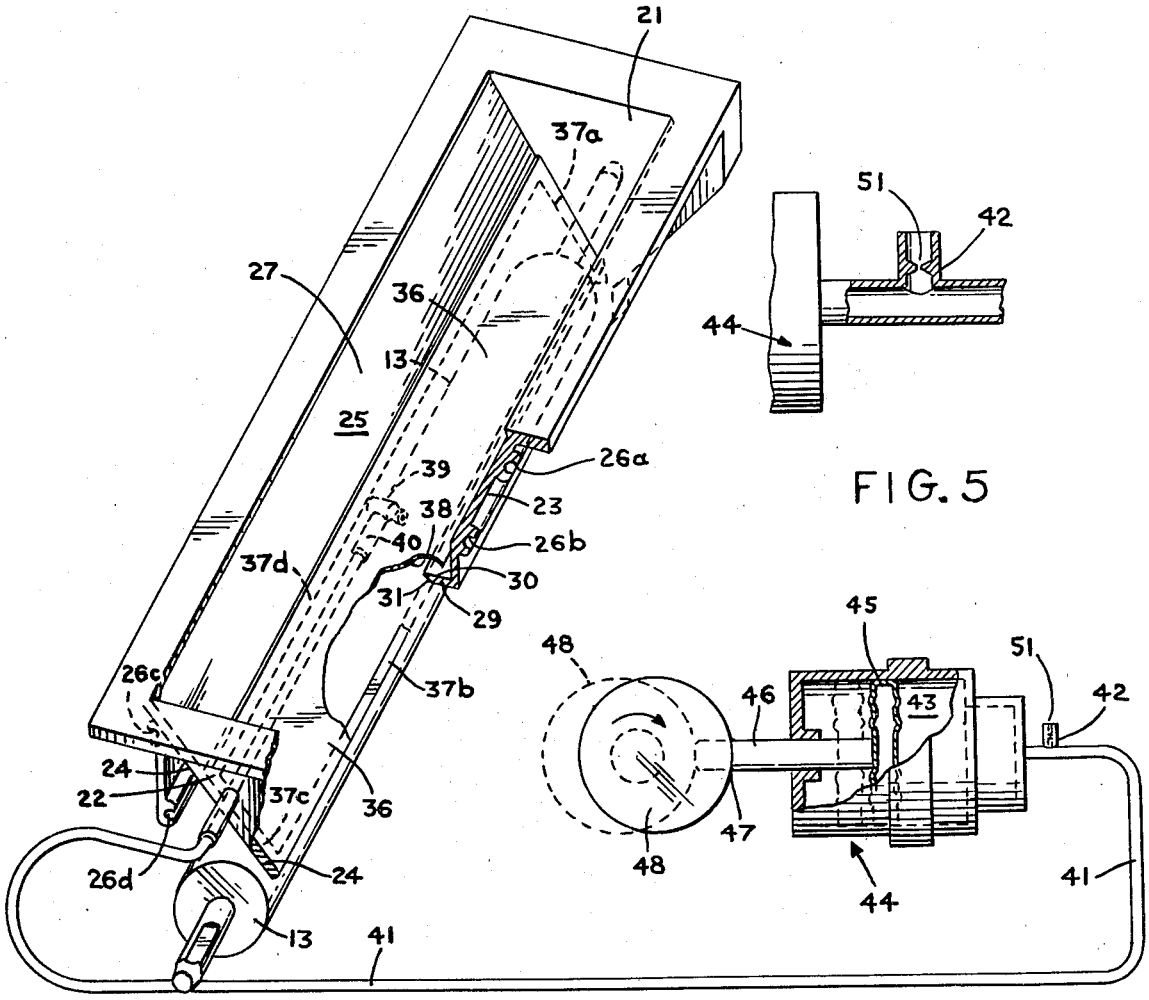
FIG. 5
FIG. 4

FEED HOPPER ASSEMBLY FOR PARTICULATE MATERIAL AND PRINTER

This is a continuation of application Ser. No. 289,760, filed Aug. 3, 1981, now abandoned.

BACKGROUND OF THE INVENTION

This invention relates generally to feed hoppers for particulate material and more particularly to a feed hopper assembly for elastroscopic/magnetic toner powder used in the printing cycle of an electrostatic printer.

Electrostatic printers utilize a toner powder to identify the electrostatic image on a charged carrier as it goes through the printing cycle. The toner powder is fed through suitable outlet ports or openings for the feed hopper in which the toner is stored until required for this purpose, the toner being delivered onto a magnetic roller which in turn deposits the toner powder on the imaged carrier.

It is well known to those skilled in the art that toner powders by the nature of their particle shape, size and electrostatic properties have a tendency to agglomerate rather than to flow freely from the outlet ports or openings provided in the feed hopper from which the toner powder is dispensed. Where this agglomeration occurs, it produces erratic feeding of the toner to the magnetic applicator which in turn causes either variable image density or no image at all on the imaged carrier.

Various devices have been utilized to overcome this problem which momentarily break up the agglomerated particles so as to permit them to flow freely onto the applicator such as, mechanical stirrers, mechanical vibrators, and other techniques as shown for example in U.S. Pat. Nos. 3,900,002, 3,870,017 and 3,752,576.

However these prior art structures and devices have the disadvantage of frequently causing a greater degree of particle agglomeration or of causing adhesion of the powder either to the hopper walls or the stirring apparatus. In the case of vibrating devices, the entire mass of powder may be densified into a coherent nonflowing mass which further compounds the problem.

The present invention provides an improved feed hopper assembly for overcoming this problem in which an expansible device such as an elastomeric diaphragm on the inner wall of the storage chamber for the feed hopper thereof will gently pulsate the toner or like type of particulate material in the storage chamber so as to reduce agglomeration of the particles and thus enable the toner or other particulate material to flow freely from the discharge outlet or opening for the feed hopper.

SUMMARY OF THE INVENTION

Thus the present invention covers an improved feed hopper assembly for particulate material comprising, wall means defining a storage chamber for the particulate material having a charging opening, said wall means having at least two spaced side members which converge towards each other to define a discharge outlet spaced from the charging opening, an expansible means in the storage chamber is connected to at least one side member adjacent the discharge outlet and a means for rhythmically inflating and deflating said expansible means is provided to gently pulsate the particulate material present in the storage chamber so as to reduce and prevent agglomeration of the particles therein and permit the same to flow freely through the outlet opening for the storage chamber.

Accordingly, it is an object of the present invention to provide an improved feed hopper assembly for particulate material which prevents bridging, blocking and hang-up of agglomerated particles in the storage chamber formed in the feed hopper thereof.

It is a further object of the present invention to provide a feed hopper assembly having an elastomeric means therein which can be pulsated to gently undulate a mass of particulate material in the storage chamber of said feed hopper so as to improve the free flow characteristics of said particulate material through the outlet opening for the feed hopper.

It is another object of the present invention to provide an improved feed hopper assembly for electroscopic/magnetic toner powder for electrostatic printing devices.

With these and other objects and advantages in view, the invention will be better understood from the following detailed description thereof when taken in connection with the accompanying drawings.

DESCRIPTION OF THE FIGURES

FIG. 3 is a back view of the feed hopper assembly shown in FIG. 1.

FIG. 4 is a perspective view of the feed hopper assembly shown in FIGS. 1, 2 and 3, partly broken away in vertical section and showing the associated pneumatic pump for operating the pulsating diaphragm assembly thereon.

FIG. 5 is an enlarged side view of the bleed orifice for the pulsating diaphragm assembly.

The present invention will be disclosed and described for use in a preferred embodiment of feeding electroscopic/magnetic toner powder in the printing cycle for an electrostatic printing device. Those skilled in the art however will readily understand that the feed hopper assembly in accordance with the present invention is equally applicable to any application wherein the problem of agglomeration of the particulate material to be dispensed from the feed hopper is met.

Figure 1:
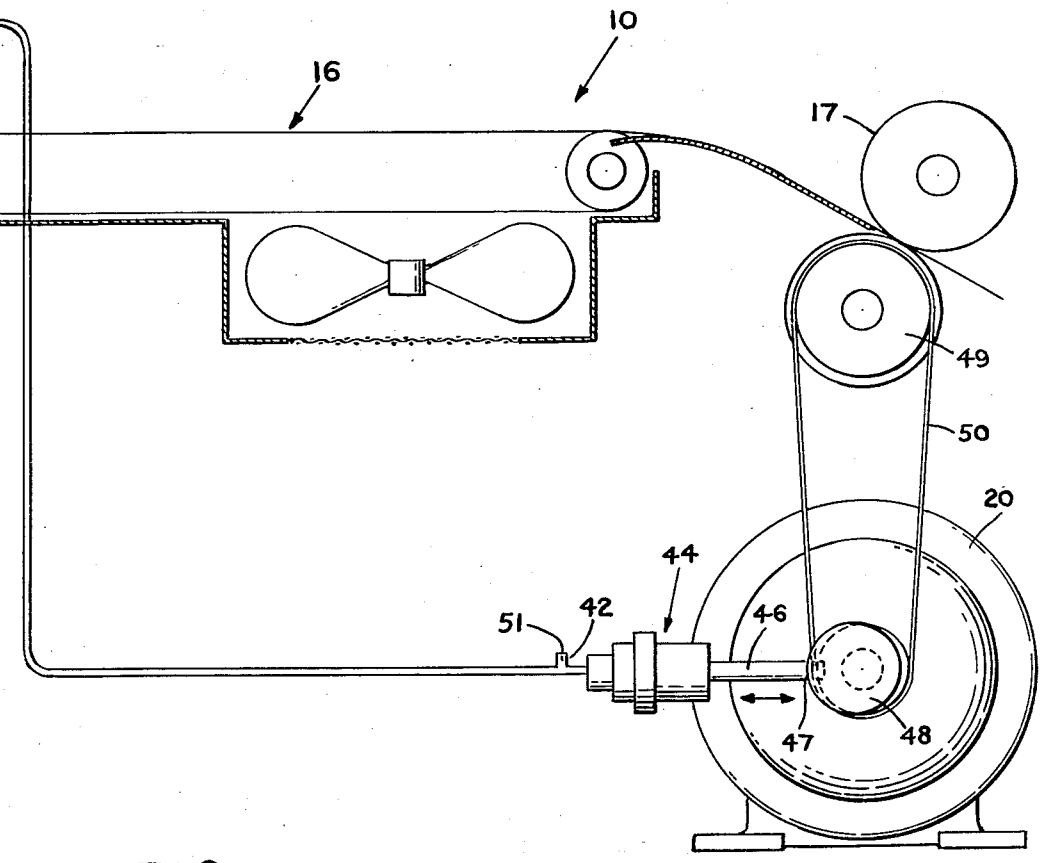
FIG. 1 is a diagrammatic sketch of an electrostatic printer showing one form of feed hopper assembly in accordance with the present invention.

Accordingly, referring to the drawings FIG. 1 shows a partial schematic sketch of the printing cycle generally designated 10 of an electrostatic printer that enables the production of hard copies of information retrieved by the system.

The printing cycle 10 includes a supply roll not shown from which the electrostatic strip is dispensed by feed rollers also not shown past various elements which impart an image having an electrostatic charge which corresponds to the information to be copied. This imaged electrostatic strip 11 is passed through a guide assembly generally designated 12 and then in operative association with a magnetic toning roller 13 having toner 14 thereon which is dispensed to the magnetic roller 13 from a feed hopper 15 in accordance with the present invention. The toner 14 from the magnetic roller 13 will be deposited on the imaged electrostatic strip because of the affinity of the toner particles for the electrostatic charge of the image on the electrostatic strip.

The electrostatic strip then passes through a suitable viewing station generally designated 16. And finally the unfused image is fused by the pressure fusing rolls 17. After being cut off by the cutters 18, the fused hard copy on the electrostatic strip is then delivered to a suitable collecting tray not shown.

The electrostatic strip is moved through the various positions above described by a suitable motor 20 which also acts to drive the pressure fusing rollers 17 as may be required during the operation of the printing cycle.

Electrostatic printers of the type herein illustrated are shown and disclosed in pending U.S. applications Ser. Nos. 899,561, 105,944 and 256,808. Accordingly this device will not be described more fully herein. Those skilled in the art are referred to these pending applications which are incorporated by reference.

The printing cycle herein illustrated has been disclosed because it coacts with the improved feed hopper 15 which is particularly adapted to maintain the toner powder 14 in particulate form so that it will spread evenly across the magnetic toning roller 13 and thus provide an image on the electrostatic strip with uniform image density in all portions thereof, which feed hopper will now be described.

Thus referring to FIGS. 2 to 5 of the drawings the feed hopper 15 is shown as having end walls as at 21 and 22 and side walls 23 and 24 are connected between the end walls to define therewith a storage chamber or hopper 25.

Suitable means as at 26*a*, 26*b*, 26*c* and 26*d* are provided for mounting the feed hopper 15 on suitable transverse rods not shown which are provided on the housing, also not shown of the associated device utilizing the feed hopper 15. It will be understood of course that while this type of mounting means is illustrated that any other suitable type of mounting means can be provided which will hold the feed hopper firmly in assembled position.

The side walls 23 and 24 are spaced from each other at the upper end of the feed hopper 15 to form a charging opening 27 for charging the particulate material such as the electroscopic/magnetic toner into the storage chamber 25 of the feed hopper 15. The side walls 23 and 24 converge towards each other so that at the lowest section of the feed hopper 15 they define a discharge outlet 28 through which the toner 14 can be discharged from the storage chamber 25 which is in communication therewith.

It will be noted that side wall 23 is further provided with a longitudinally aligned lateral projection as at 29 which extends transversely of the longitudinal line of the feed hopper 15 across the exit side of the discharge outlet 28 and a spaced distance beyond the outlet 28 to provide a transfer shelf or surface 30 for the toner 14 which flows through the discharge outlet 28 to the magnetic toning rollers 13. The edge 31 of the lateral projection 29 adjacent to the magnetic toning roller 13 is beveled so that the lateral projection 29 coacts with the magnetic toner roller 13 as a doctor blade for adjusting the thickness of the toner powder on the outside of the magnetic toning roller 13.

The feed hopper in accordance with the present invention is particularly adapted for preventing the agglomeration or clumping of particulate materials such as occurs with the electroscopic/magnetic toner powder and for this purpose a pulsating diaphragm assembly generally designated 35 is provided on at least one of the side walls of the feed hopper 15.

Thus by reference to FIGS. 2, 3, 4 and 5 the pulsating diaphragm assembly 35 is shown as including an elastomeric element 36 which is bonded on its edges as at 37*a*, 37*b*,*k* 37*c* and 37*d* to the side wall 24 which is opposite from the side wall 23 having the lateral projection 29 thereon. The elastomeric member is preferably bonded so that it covers the lower section of the side wall 24 and any suitable type of elastomeric material which is inert to the toner powder and non-conductive may be utilized for this purpose.

For example the elastomeric member 36 may be made from polyurethane, natural amber gum rubber sheeting; neoprene, or fluorocarbon resin elastomers such as those sold under the trademark "VITON". Further, in the bonding of the elastomeric element 36, the bonding material must have a high peel strength to withstand the repeated inflating and deflating of this element as hereinafter described.

Figure 2:
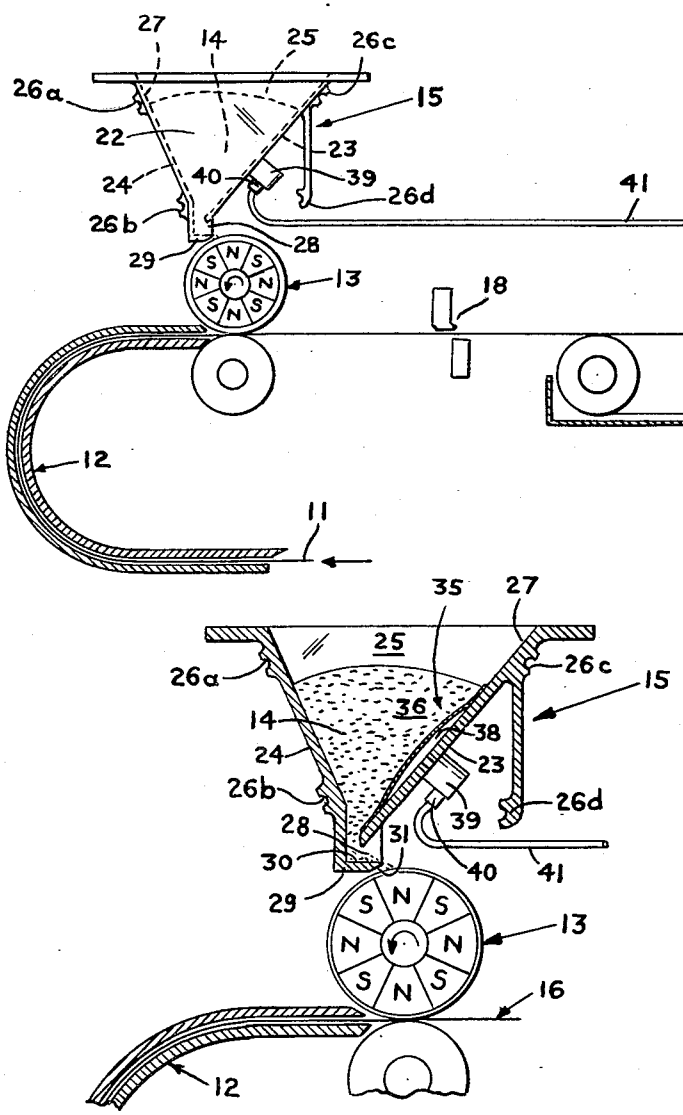
FIG. 2 is an enlarged vertical section of the feed hopper assembly shown in FIG. 1 showing the operative relation thereof to the magnetic toning roller.

When the elastomeric member 36 is in assembled position, a space 38 is formed between the inner face of the side wall 24 and the elastomeric member 36 as is shown in FIGS. 2 and 4 of the drawings. FIG. 2 shows the elastomeric member 36 in the expanded position. The elastomeric member 36 should have sufficient elasticity to provide an expansion of 0.050" to 0.100" at the center thereof.

By filling this space with any suitable type of fluid such as air and then removing the fluid, the elastomeric member can be expanded or inflated and then deflated. If this is done a plurality of times, a pulsating effect will be produced for gently moving and undulating the particulate material such as the toner powder which is in the storage chamber 25 adjacent to the elastomeric member 36.

In the illustrated form of pulsating diaphragm, this is accomplished with air which is delivered by means of the air connection 39 in the side wall 24 to deliver air to the space 38 and remove the air therefrom. Air connection 39 is connected as at 40 to one end of the air conduit 41 having the end remote therefrom connected by the three way connector 42 to the air chamber 43 of a bellows type pumping assembly 44. A bellows 45 disposed in the air chamber 43 compresses and expands the air therein when the bellows is reciprocated. The bellows 45 is reciprocated by an actuating rod 46 connected to the bellows at one end and disposed for operative engagement at the other end 47 with an eccentric driven cam roller 48 which is driven whenever the motor 20 is placed in operation to drive the pressure fusing rollers thus preparing the magnetic toning roller 13 for the next electrostatic image to be toned.

Thus when the motor 20 acts to drive the pressure fusing rollers 13 as by any suitable pulley and belt mechanism 49 and 50 so as to deposit toner 14 on the electrostatic strip as above described, the motor will simultaneously drive the driven cam roller 48 to oscillate the actuating rod 46 and the bellows 45 connected thereto so that the bellows pump will pump air through the air conduit 41 and the air connection 39 into the space 38 and remove the same air alternately as the actuating rod follows the eccentrically mounted cam roller thus alternatively inflating or expanding and then deflating the elastomeric member 36 to provide the desired pulsations for reducing the agglomerated toner back into its preferred particulate form for delivery through the discharge outlet 38 and along the shelf or surface 30 on the lateral projection 29 onto the magnetic toning roller 13.

Thus a simple pulsating diaphragm assembly is provided for imparting gentle motion to the mass of toner powder by means of the elastomeric member 36 thereon, thus avoiding the disadvantages of the known prior art devices which act to reduce the flow characteristics of such particulate material rather than improve the same as is accomplished with the device as above disclosed.

The three way connector 42 for connecting the line 41 to the pump 44 has an outlet to atmosphere through air orifice 51, as is shown in FIGS. 1 and 5 of the drawings. The orifice is so sized that it will not interfere with the normal operation for pulsating the diaphragm assembly 35 above described. However, if the pulsations should terminate at any time with the elastomeric member 36 in the inflated or expanded position, the orifice will permit the air present in the space 38 to bleed out therethrough. This prevents damage to the elastomeric member 36 if thermal changes or other problems cause undue expansion of the air charged into the space 38 for operating the elastomeric member 36.

It will be understood that the invention is not to be limited to the specific construction or arrangement of parts shown but that they may be widely modified within the invention defined by the claims.

What is claimed is:

1. A feed hopper assembly for particulate material comprising:

a. wall means including spaced and converging side walls each respectively having an inner surface and an outer surface, and spaced end walls at opposite ends of said wall to define therewith a storage chamber having an upper opening for charging particulate material therein, b. one of said converging side walls having a length longer than that of the other shorter converging side wall, c. said longer converging side wall having, a shelf means formed at the lower end disposed to extend transversely through and in relatively close proximity below the other shorter side wall to form therewith a sized discharged outlet means, d. flexible diaphragm means connected to the inner face of at least one of said converging side walls to form an expansible chamber disposed for operative communication with the particulate material charged into the storage chamber formed in the feed hopper, e. pneumatic pulsating means connected to the outer face of said one side wall having the flexible diaphragm means connected to the inner face thereof including, means in the side wall forming an air passage therethrough communicating at one end with the expansible chamber, a pumping means for pumping air, conduit means connected at one end to the air inlet means and at the opposite end to said pumping means for delivering and removing air to and from said expansible chamber for expanding and deflating the flexible diaphragm means, and means for driving the pumping means for intermittently expanding the flexible diaphragm means to undulate the particulate material charged into the storage chamber and to cause the same to flow directly and freely through said discharge outlet means to said shelf means, and f. bleed means connected in said pneumatic pulsating means for bleeding air from the pneumatic pulsating means above a predetermined pressure.

2. In the feed hopper assembly as claimed in claim 1 wherein the bleed means includes, a bore end to end therethrough, and means connected in the bore of said bleed means forming a sized orifice for setting the predetermined pressure level above which said bleed means operates whereby air is continuously bled from the pneumatic pulsating means and also bled in the event that pulsations of the flexible diaphragm means terminate with the same in the expanded condition.

3. In an electrostatic printer having a rotatable magnetic toning roller for delivering electrostatic/magnetic toner for the printing cycle therein, rotatable pressure fusing rollers, means for driving the magnetic toning roller, and means for driving the rotatable pressure fusing rollers, the combination with said rotatable magnetic toning roller of, a feed hopper assembly comprising:

a. wall means including spaced and converging side walls each respectively having an inner surface and an outer surface, and spaced end walls at opposite ends of said wall to define therewith a storage chamber having an upper opening for charging particulate material therein, b. one of said converting side walls having a length longer than that of the other shorter converging side wall, c. said longer converging side wall having, a shelf means formed at the lower end disposed to extend tranversely through and in relatively close proximity below the other shorter side wall to form therewith a sized discharged outlet means, d. flexible diaphragm means connected to the inner face of at least one of said converging side walls to form an expansible chamber disposed for operative communication with the particulate material charged into the storage chamber formed in the feed hopper, e. pneumatic pulsating means connected to the outer face of said one side wall having the flexible diaphragm means connected to the inner face thereof including, means in the side wall forming an air passage therethrough communicating at one end with the expansible chamber, a pumping means for pumping air, conduit means connected at one end to the air inlet means and at the opposite end to said pumping means for delivering and removing air to and from said expansible chamber for expanding and deflating the flexible diaphragm means, and means for driving the pumping means for intermittently expanding the flexible diaphragm means to undulate the particulate material charged into the storage chamber and to cause the same to flow directly and freely through said discharge outlet means to said shelf means, and f. bleed means connected in said pneumatic pulsating means for bleeding air from the pneumatic pulsating means above a predetermined pressure, g. said shelf means operatively associated with the magnetic toning roller to deliver the metered amount of particulate material discharged thereon when the magnetic toning roller is rotated, and h. the means for driving the pressure fusion rollers operatively connected to said pump means for synchronous and intermittent operation thereof to enable the delivery of air to the flexible diaphragm means in accordance with the operation of the electrostatic printer.

4. In the combination as claimed in claim 3, wherein the bleed means includes, a bore end to end therethrough, and means connected in the bore of said bleed means to form a sized orifice for setting the predetermined pressure at which air is continuously bled from the pneumatic pulsating means and also bled in the event that pulsations of the flexible diaphragm means terminate with the same in the expanded condition.

* * * * *